US005549159A

United States Patent [19]

Shwe et al.

[11] Patent Number: 5,549,159

[45] Date of Patent: Aug. 27, 1996

[54] FORMATION TESTING METHOD AND APPARATUS USING MULTIPLE RADIALLY-SEGMENTED FLUID PROBES

[75] Inventors: Than Shwe; John M. Michaels, both of Houston, Tex.

[73] Assignee: Western Atlas International, Inc., Houston, Tex.

[21] Appl. No.: 493,802

[22] Filed: Jun. 22, 1995

[51] Int. Cl.[6] ..... E21B 49/10

[52] U.S. Cl. ..... 166/250.02; 166/100; 166/187; 166/191; 166/250.17

[58] Field of Search ..... 166/250.02, 250.17, 166/191, 187, 264, 100; 73/155

[56] References Cited

U.S. PATENT DOCUMENTS

| | | | |
|---|---|---|---|
| 2,511,759 | 6/1950 | Williams | 166/100 |
| 2,581,070 | 1/1952 | Blood | 166/100 |
| 2,781,663 | 2/1957 | Maly et al. | 166/264 X |
| 3,181,608 | 5/1965 | Palmer | 166/250.02 |
| 4,535,843 | 8/1985 | Jageler | 166/250 |
| 4,742,459 | 5/1988 | Lasseter | 166/100 X |
| 4,936,139 | 6/1990 | Zimmerman et al. | 73/155 |
| 5,269,180 | 12/1993 | Dave et al. | 166/250.02 X |
| 5,279,153 | 1/1994 | Dussan et al. | 73/155 |
| 5,335,542 | 8/1994 | Ramakrishnan et al. | 73/152 |

*Primary Examiner*—Hoang C. Dang

*Attorney, Agent, or Firm*—Richard A. Fagin

[57] ABSTRACT

An apparatus for withdrawing fluid from an earth formation comprising an elongated housing, a first inflatable elastomeric seal adapted to expansively fill an annular space between the housing and the wall of a wellbore. The seal includes axially spaced seal lips protruding from a surface of the seal. The seal lips circumscribe the seal and define a flow channel therebetween. The flow channel includes radially spaced filler blocks which divide the channel into radial segments. Each segment further includes a flow port. The apparatus includes means for inflating the seal. The apparatus includes valves connected to each of the flow ports for connecting selected flow ports to an intake of a fluid pump and connecting selected other flow ports to a discharge port of the pump. The pump is operable in conjunction with the valves to withdraw fluid from selected flow ports and to discharge fluid into other flow ports. The apparatus includes a fluid discharge port connected to the valves, and in hydraulic communication with the wellbore so that fluid withdrawn from the flow ports can be discharged into the wellbore, and fluid withdrawn from the wellbore can be discharged through the flow ports. The apparatus includes a pressure transducer connected to the pump intake so that a pressure of the fluid withdrawn is determined. A preferred embodiment includes a second pressure transducer connected to the pump discharge and differential pressure transducers interconnected between adjacent flow ports to measure radial differences in pressure.

20 Claims, 5 Drawing Sheets

FORMATION TESTING METHOD AND APPARATUS USING MULTIPLE RADIALLY-SEGMENTED FLUID PROBES

BACKGROUND OF THE INVENTION

1. Field of the Invention

The present invention is related to the field of electric wireline tools used to withdraw samples of fluids contained within pore spaces of earth formations. More specifically, the present invention is related to systems for determining various fluid flow properties of earth formations by using a formation testing apparatus having a plurality of fluid sampling probes which are radially and axially spaced apart and hydraulically isolated from each other.

2. Description of the Related Art

Electric wireline formation testing tools are used to withdraw samples of fluids and to make pressure measurements of fluids contained within pore spaces of earth formations. Calculations made from these measurements can be used to assist in estimating the total fluid content within the earth formations.

Formation testing tools known in the art are typically lowered at one end of an armored electrical cable into a wellbore drilled through the earth formations. The formation testing tools known in the art can include a tubular probe which is extended from the tool housing and is then impressed onto the wall of the wellbore. The probe typically is externally sealed by an elastomeric packing element to exclude fluids from within the wellbore itself from entering the interior of the probe as fluids are withdrawn from the earth formation through the probe. Various valves selectively place the probe in hydraulic communication with sample chambers included in the tool. The probe can also be connected to a highly accurate pressure sensor which measures the fluid pressure at or near the probe. Other sensors in the tool can make measurements related to the volume of fluid which has entered the sample chambers during a test of a particular earth formation. The formation testing tools known in the art can also include a sample tank. The sample tank can be selectively connected to the probe so that a quantity of fluid withdrawn from the formation can be discharged into the sample tank and transported to the earth's surface for laboratory analysis.

Other formation testing tools known in the an can include more than one probe. For example, one formation testing tool known in the art includes two collinear probes positioned at axially spaced-apart locations along the tool. By providing two probes at axially spaced apart locations, it is sometimes possible to determine to what extent a particular earth formation has permeability coaxial with the wellbore. Typically, one of the two probes in the two-probe tool is used to withdraw fluid from the formation while monitoring fluid pressure at the tither probe. The time elapsed between withdrawal of the fluid at the one probe and indication of pressure drop at the other probe can be indicative of the coaxial permeability of the earth formation.

A drawback to the two-probe tool known in the art is that it is unable to resolve permeability discontinuities which may cross the wellbore at certain oblique angles. Using the two-probe tool known in the art, it is possible that coaxial permeability discontinuities which may be observed with the tool in one rotary orientation within the wellbore may not be observed in other rotary orientations, which allows the possibility that coaxial permeability discontinuities of significant interest to the wellbore operator could go undetected.

It is also known in the art to provide a formation testing tool having two probes opposingly faced and located at substantially the same axial position along the tool in addition to the axially spaced apart collinear probes. The opposingly faced probes can observe some permeability discontinuities intersecting the wellbore obliquely which may be missed by the axially-spaced apart probes. Such a tool is described for example in U.S. Pat. No. 5,335,542 issued to Ramakrishnan et al.

A drawback to the tool in the Ramakrishnan '542 patent having opposingly faced probes is that this tool may provide insufficient radial resolution to observe permeability discontinuities which may traverse the wellbore in such a way as to make the apparent permeability substantially equal as observed by either opposing probe relative to the axially spaced-apart probe.

A still further drawback to the formation testing tools known in the art is that the probes used to withdraw fluid samples typically have small cross-sectional areas relative to the surface area of the wellbore. Some features of earth formations which can be highly productive of oil and gas may intersect only a very small portion of the surface area of the wellbore and there wellbore have a high probability of being missed by one of the probes on the formation testing tools known in the art. Such features can include fractures or thin layers of permeable sandstone interleaved with impermeable strata such as shale.

It is known in the an to provide a means for isolating a substantial axial section of the wellbore so that the entire surface area of the wellbore within the section can be exposed to fluid withdrawal by a formation testing tool. Axial sections can be isolated by providing a device known as a straddle packer. The straddle packer known in the an includes two inflatable elastomeric bladders positioned at axially-spaced apart locations along the tool. A port is provided on the tool at an axial position in between the bladders. The port can be selectively hydraulically connected to the various sample chambers of the formation testing tool. As it is typically used, the straddle packer is positioned within a zone of interest, the bladders are inflated to hydraulically isolate the zone and fluid is withdrawn through the port by various pumping and flow control devices in the tool.

A drawback to the straddle packer is that the bladders can only isolate the zone of interest axially. The straddle packer is unable to provide measurements determining permeability coaxial with the wellbore or for determining the presence of coaxial permeability discontinuities intersecting the wellbore. Further, the large volume which is isolated between the bladders results in a large volume of fluid that must be withdrawn from the axial section bladder native fluid from the formation enters the testing tool. Withdrawing a large fluid volume can require leaving the tool in place for a long time. Leaving the tool in place for a long time can be unsafe and expensive. Further, the capacity of the fluid pumps in formation testing tools known in the art is limited. It can be difficult to determine the permeability of highly permeable formations using the straddle packer tool known in the art, because the large surface area of the wellbore which is exposed to fluid withdrawal can provide a high volume of fluid relative to the volume that the pump is capable of withdrawing. If the formation can produce fluid faster than the fluid can be pumped away, then substantially no pressure drop will occur. To determine permeability requires at least some amount of pressure drop from the earth formation's original pressure to be measured.

It is an object of the present invention to provide an electric wireline formation testing tool which can provide improved radial resolution of permeability discontinuities intersecting the wellbore.

It is a further object of the present invention to provide a formation testing tool which can withdraw fluid from permeable features intersecting the wellbore which have a small surface area, while reducing the volume of fluid tram within the wellbore which must be pumped away before sampling of the native fluid can begin.

It is yet a further object of the present invention to provide a formation testing tool which can withdraw fluid from permeable features intersecting the wellbore which have a small surface area, while maintaining the ability to determine permeability of the formation even if the permeability is very high.

SUMMARY OF THE INVENTION

The present invention is an apparatus for withdrawing fluid from an earth formation penetrated by a wellbore. The apparatus includes an elongated housing and a first inflatable elastomeric seal disposed on the housing and adapted to expansively fill an annular space between the housing and the wellbore. The apparatus further includes means for selectively inflating the seal. The seal includes axially spaced apart seal lips protruding from an exterior surface of the seal. The seal lips circumscribe the seal and define a flow channel between them. The flow channel includes radially spaced apart filler blocks which divide the channel into radial segments. Each one of the segments further includes a flow port. The apparatus also includes valves connected to each one of the flow ports for connecting selected ones of the flow ports to an intake of a fluid pump disposed within the housing and connecting selected other ones of the flow ports to a discharge port of the pump. The pump is selectively operable in conjunction with the valves to withdraw fluid from selected ones of the flow ports and to discharge fluid into other selected ones of the flow ports. The apparatus includes a fluid discharge port connected to the valves, and in hydraulic communication with the wellbore so that fluid withdrawn from selected ones of the flow ports can be selectively discharged into the wellbore, and fluid selectively withdrawn from the wellbore can also be selectively discharged through selected ones of the flow ports. The apparatus also includes a pressure transducer connected to the pump intake so that a pressure of the fluid withdrawn by the pump can be determined.

A preferred embodiment of the invention includes a second pressure transducer connected to the pump discharge and differential pressure transducers selectively interconnected between adjacent ones of the flow ports to measure radial differences in fluid pressure during fluid withdrawal from, or discharge into, the formation.

A specific embodiment of the invention includes a second elastomeric seal axially spaced apart from the first seal. The second seal also includes seal lips, filler blocks and flow ports which can be selectively connected to the pump intake and discharge.

The present invention is also a method of determining the presence of hydraulic discontinuities in an earth formation penetrated by a wellbore. The method comprises the steps of positioning a formation testing tool in the wellbore adjacent to the earth formation and hydraulically isolating a first and second portions of the earth formation by expanding, respectively, a first seal and a second seal against the wall of the wellbore. The first and second seal include radial flow isolators for hydraulically isolating radial segments of the first and second portions of the wall of the wellbore. The method includes operating valves and a pump disposed in the testing tool to selectively withdraw fluid from the first portion, measuring fluid pressure at each one of the radial segments of the second portion, and determining the presence of discontinuities from differences in pressure between the radial segments of the second portion.

DESCRIPTION OF THE PREFERRED EMBODIMENT

Figure 1:
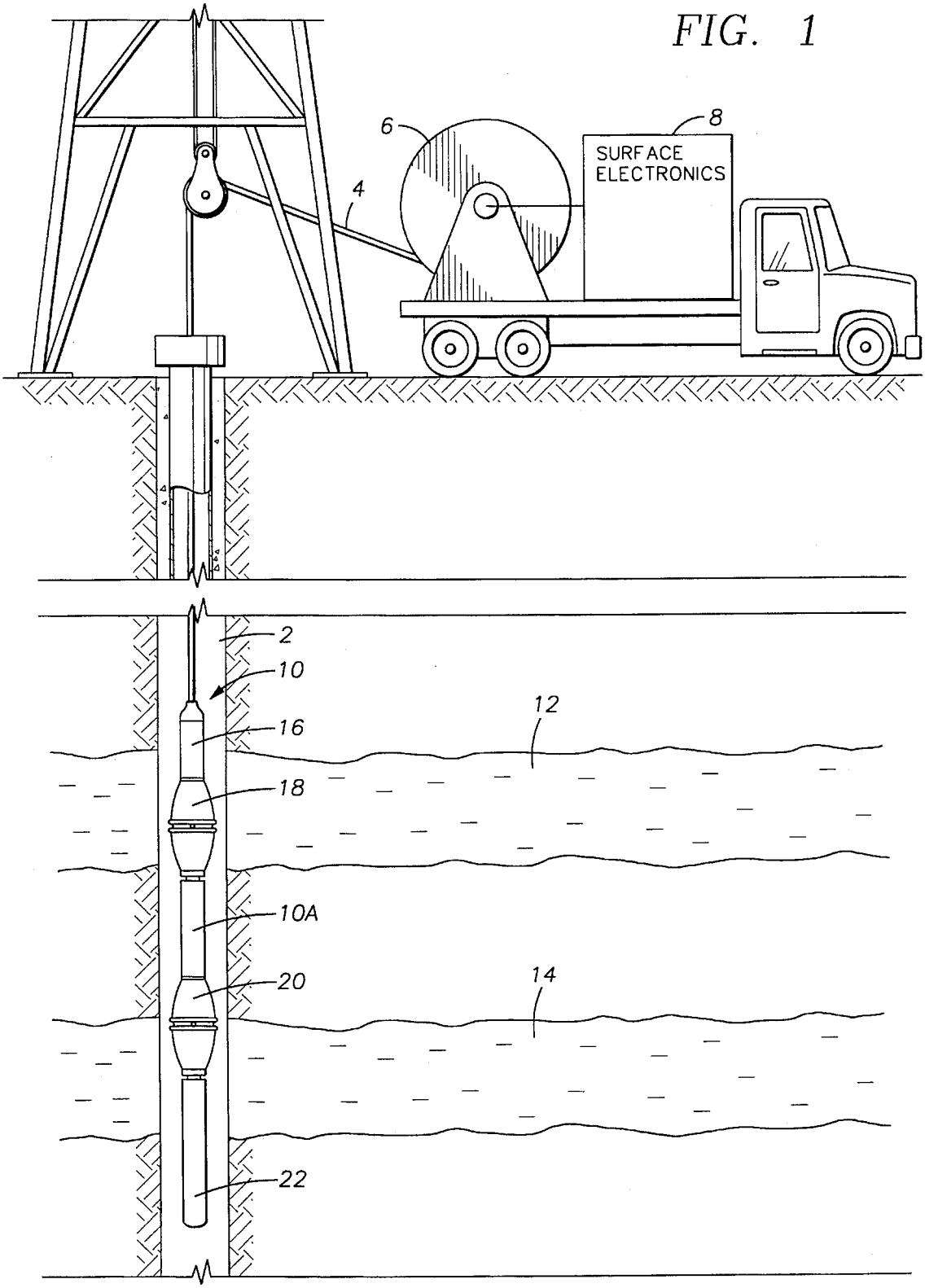
FIG. 1 shows a formation test tool according to the present invention being lowered into a wellbore penetrating earth formations.

FIG. 1 shows a formation testing tool 10 according to the present invention being lowered into a wellbore 2 penetrating earth formations, shown generally at 12 and 14. The tool 10 can be lowered into the wellbore at one end of an armored electrical cable 4. The cable 4 can be extended into the wellbore by means of a winch 6 or similar device known in the art. The cable 4 is electrically connected to a surface electronics unit 8 which can include a computer (not shown) for receiving and interpreting signals transmitted by the tool 10, as will be further explained.

The tool 10 includes an electronics section 16 which can receive and interpret command signals transmitted from the surface electronics 8 in response to the system operator entering commands therein, as will be further explained. The commands are entered for, among other things, selectively operating various hydraulic valves in the tool 10 to direct flow of fluids as desired by the system operator, as will also be further explained.

The tool 10 can include a first 18 and a second 20 inflatable bladder seal section. The first 18 and second 20 inflatable bladder seal sections are attached to a hydraulic power unit 10A used to selectively inflate each seal section, which will be further explained. The first 18 and second 20 bladder seal sections can be axially spaced apart by a distance which is related to the expected vertical permeability, as is understood by those skilled in the art. The selected axial spacing of the first 18 and the second 20 bladder seal sections is a matter of convenience for the system operator and is not to be construed as a limitation on the invention. Operation of the bladder seal sections 18.20 will be further explained.

The tool can also include a sample tank 22. As will be further explained, fluids withdrawn from the earth formations 12, 14 can be discharged into the tank 22 upon control of the appropriate valves (not shown in FIG. 1) upon entry of the appropriate command by the system operator. Fluids thus discharged into the tank 22 can be transported to the earth's surface for laboratory analysis. Other fluids (not shown) can be transported from the earth's surface into the wellbore by the sample tank 22 for selectively discharging the other fluids into the earth formations 12, 14 for certain types of tests known in the art such as injectivity testing.

Figure 2:
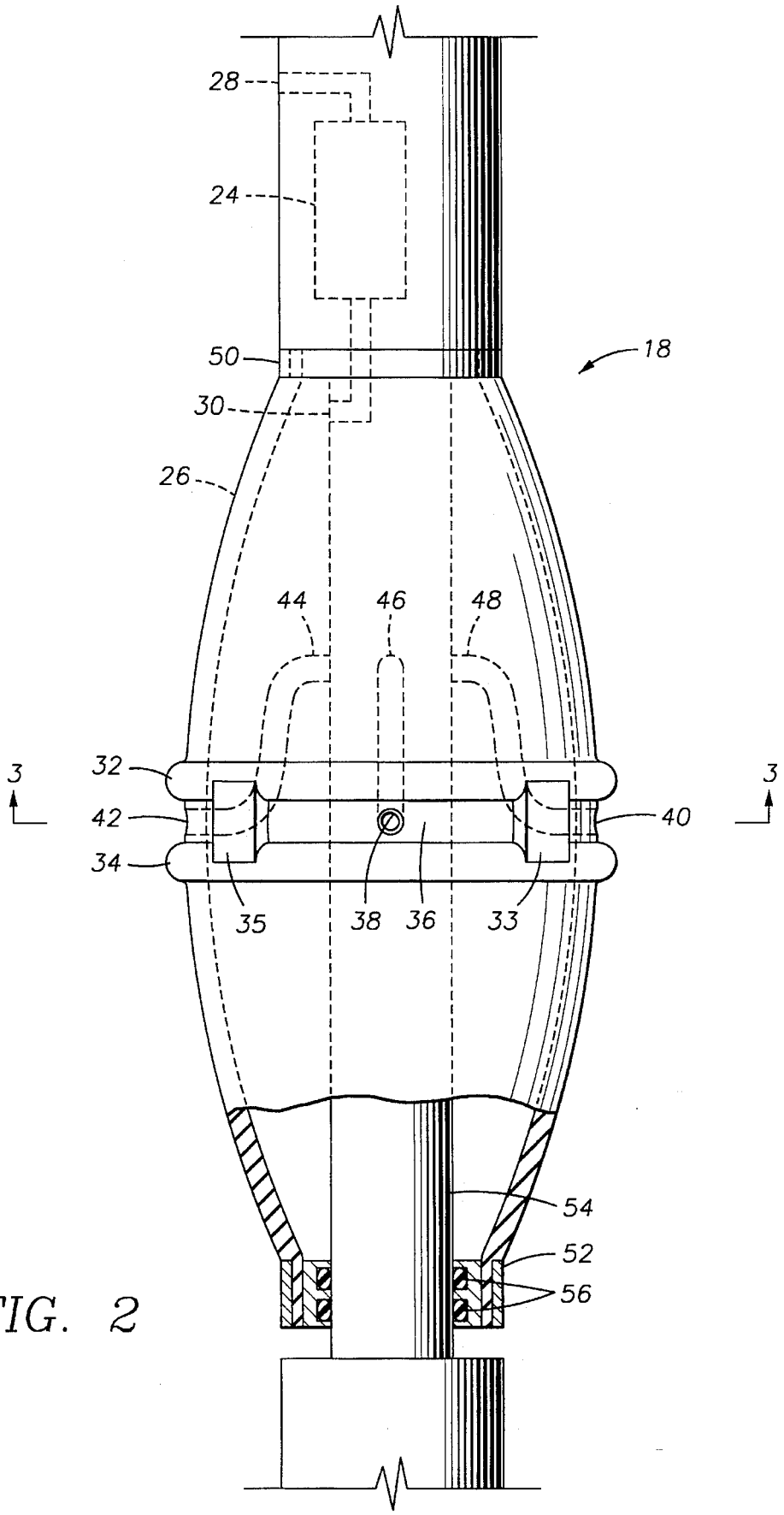
FIG. 2 shows an expanded view of an inflatable bladder seal having four radially separated snorkels.

FIG. 2 shows the first inflatable bladder seal section 18 in more detail. The first seal section 18 includes a reinforced elastomeric bladder 26. The reinforcement is formed into the elastomeric material and can be of a type known in the art such as steel wire or glass fiber. The bladder 26 can be inflated by pumping fluid from the wellbore (shown as 2 in FIG. 1) into the interior of the bladder 26. The pumping can be performed by a reversible, electrically powered fluid pump, shown generally at 24. The pump 24 can be hydraulically connected on one side to the wellbore 2 by a first port 28 and hydraulically connected on its other side to the interior of the bladder 26 by a second port 30. Alternatively, the bladder 26 can be inflated by a fluid, such as hydraulic oil, which can be transported within the tool 10 in a separate reservoir (not shown). The bladder 26 can be sealed between its interior and exterior, and substantially immovably mounted on one end by a seal ring 50. The opposite end of the bladder 215, as shown at 52, can be mounted on a portion of the tool 10, shown at 54, which forms a sealing surface for the other end of the bladder 26, so that the end 52 can slidably move while maintaining an hydraulic seal between the interior and exterior of the bladder 26. Hydraulic sealing of the slidably mounted end 52 of the bladder 26 can be performed by o-rings, shown at 56. As fluid is pumped into the bladder 26, its outside diameter typically expands, and the slidably mounted end 52 is typically withdrawn towards the fixed end (mounted at ring 50) as is understood by those skilled in the art. Reversing the pump 24 enables the system operator to selectively deflate the bladder 26 so that its external diameter shrinks, enabling the tool (10 in FIG. 1) to be moved within the wellbore (2 in FIG. 1).

The bladder 26 of the present invention includes an upper seal lip 32, and a lower seal lip 34 axially spaced apart from the upper seal lip 32. Both seal lips 32, 34 can be integrally formed into the surface of the elastomeric material which forms the bladder 26. Both seal lips 32, 34 circumscribe the bladder 26, in a plane substantially perpendicular to the axis of the bladder 26. Both seal lips 32, 34 can be internally reinforced with a substantially incompressible material, such as steel or glass-fiber reinforced plastic, which will maintain the general profile of the seal lips 32, 34, but will also enable sufficient compression of the seal lips 32, 34 to seal against the wellbore (2 in FIG. 1) wall when the bladder 26 is expanded. In the preferred embodiment of the invention, the axial spacing of the seal lips 32, 34 can be about one-half inch. The axial spacing of the seal lips 32, 34 is not to be construed as an explicit limitation on the invention.

The spaced-apart seal lips 32, 34 define a flow channel therebetween, as shown at 36. The flow channel 36 can be hydraulically connected to a plurality of low ports, shown for example at 38, 40 and 42. As will be further explained, the flow ports, 38, 40, 42 can be connected, respectively, to hydraulic hoses, such as shown at 46, 48 and 44, to enable fluid from the formation (12 and 14 in FIG. 1) to move through various hydraulic lines in the tool (10 in FIG. 1) as selected by the system operator entering appropriate commands into the surface electronics (8 in FIG. 1).

The flow channel 36 can be radially segmented by filler blocks, such as ones shown at 33 and 35 which substantially fill the flow channel 36 and create a flow barrier between any two of the flow ports 38, 40, 42. By radially segmenting the flow channel 36, each flow port 38, 40, 42 can be placed in hydraulic communication with a segment of the formation (12, 14 in FIG. 1) defined by the axial spacing of the seal lips 32, 34 and radially defined by the positions of the filler blocks 33, 35. In the preferred embodiment of the invention, the flow channel 36 comprises four filler blocks radially spaced apart at about 90 degrees, and the flow channel includes for hydraulically isolated flow ports. It is to be understood that other quantities of filler blocks and flow ports within the flow channel 36 of the present invention would also accomplish the intended purpose of radial segmentation of the hydraulic connection of a flow port to the earth formation.

When the bladder 26 is expanded, the flow channel 36 is placed in hydraulic communication with an area of the formation (12, 14 in FIG. 1) on the wall of the wellbore 2 which is much larger than the cross-sectional area of an individual flow port (such as 38). The cross-sectional area of the radial segments is also larger than the cross-sectional area of a tubular probe typically used in formation testing tools known in the prior art, and is therefore much less likely than such probes to encounter complete impermeability at any particular position on the wellbore 2 wall when testing earth formations which include variable permeability features such as shale laminae.

The enclosed volume of the flow channel 36 is still relatively small, however, when compared with the enclosed flow volume of a device known in the art called a straddle packer. The straddle packer isolates an axial section of the formation 12 or 14 by expanding two, axially spaced apart inflatable bladder seals against the wall of the wellbore 2. The axial section of the straddle packer has a volume substantially equal to the volume of a cylinder having a diameter of the wellbore and a length of the axial spacing between the seals. It is therefore possible, using the seal section 18 of the present invention, to withdraw fluids from the earth formation which might be missed by the probe of the formation testing tools known in the prior art, but the amount of fluid which must be withdrawn from the wellbore 2 itself is kept to a minimum compared with the straddle-packer testing tools known in the prior art.

The seal section 18 of the present invention, by having only a small surface area of the wellbore 2 wall hydraulically connected to the sampling components in the tool 10, enables the use of fluid pumps typically included with formation testing tools known in the art to withdraw fluids from the earth formation at sufficient rates to be able to estimate formation permeability.

Figure 3:
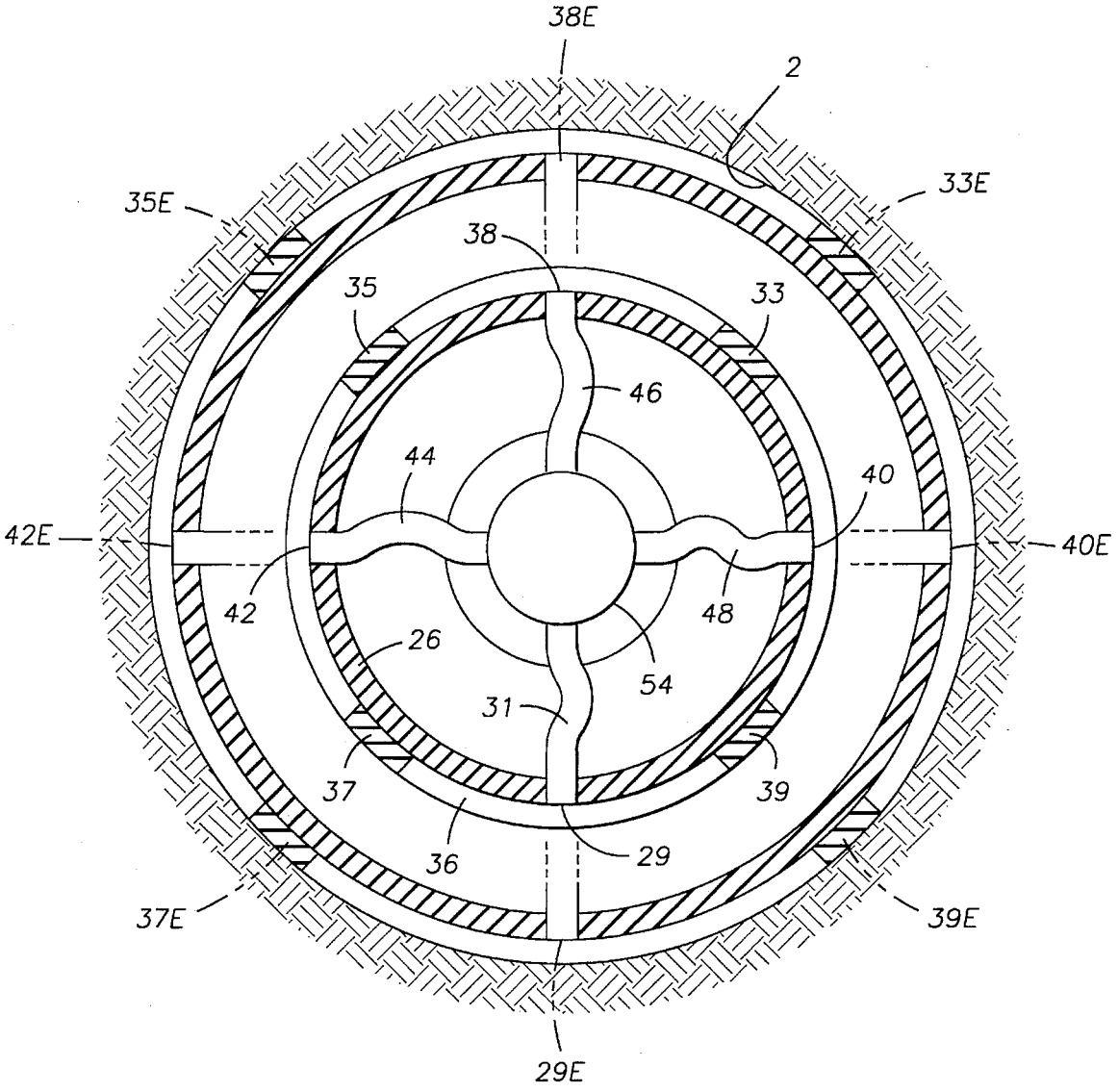
FIG. 3 shows a cross-section of the inflatable bladder seal in its retracted state and expanded to contact the wall of the wellbore.

A better understanding of the operation of the seal section 18 according to the present invention can be obtained by referring to FIG. 3, which is a cross-sectional view of the seal section 18 along section A–A' of FIG. 2. FIG. 3 shows the cross section A–A', both with the bladder 26 expanded, and with the bladder 26 deflated or retracted. The flow channel 36 is shown divided by four filler blocks 33, 35, 37, 39 into hydraulically isolated segments (not separately designated). Each segment in the flow channel 36 is further connected to one of four flow ports, 29, 38, 42 and 40. The ports are each connected, respectively, to hydraulic hoses 31, 46, 44 and 48. The expanded bladder can be observed with the flow channel at 36E, the ports at 29E, 42E, 40E and 38E and the blocks at 33E, 35E, 37E and 39E. As will be readily understood by those skilled in the art, the hydraulic hoses 31, 44, 48, 46 provide flexible coupling of the ports 29, 42, 40, 38 to hydraulic lines (which will be further explained) in the tool (10 in FIG. 1) so as to enable expansion and contraction of the bladder (26 in FIG. 2) as required by the system operator while maintaining hydraulic connection of the flow ports to valves in the tool, which will be further explained.

Referring again to FIG. 1, the preferred embodiment of the tool 10 can have two seal sections, shown at 18 and 20. It is to be understood that other configurations of the tool 10 according to the present invention could include other quantities of seal sections. The quantity of seal sections is not to be construed as a limitation on the invention.

Figure 4A:
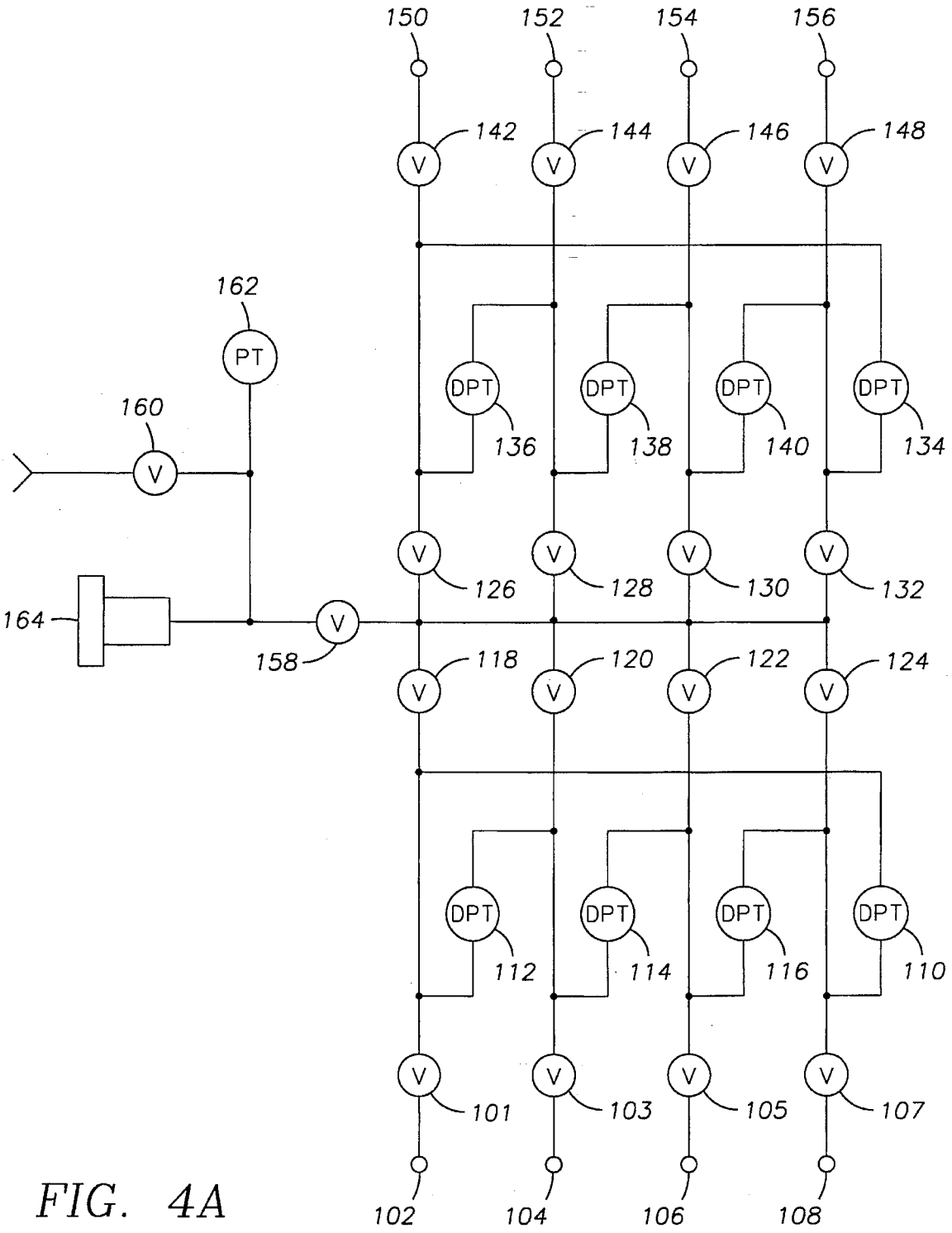
FIG. 4A shows hydraulic control valves for operating the connection of each one of the ports in a formation testing tool including two of the inflatable bladder seals. Connections are selectively made to the intake of a pump.
Figure 4B:
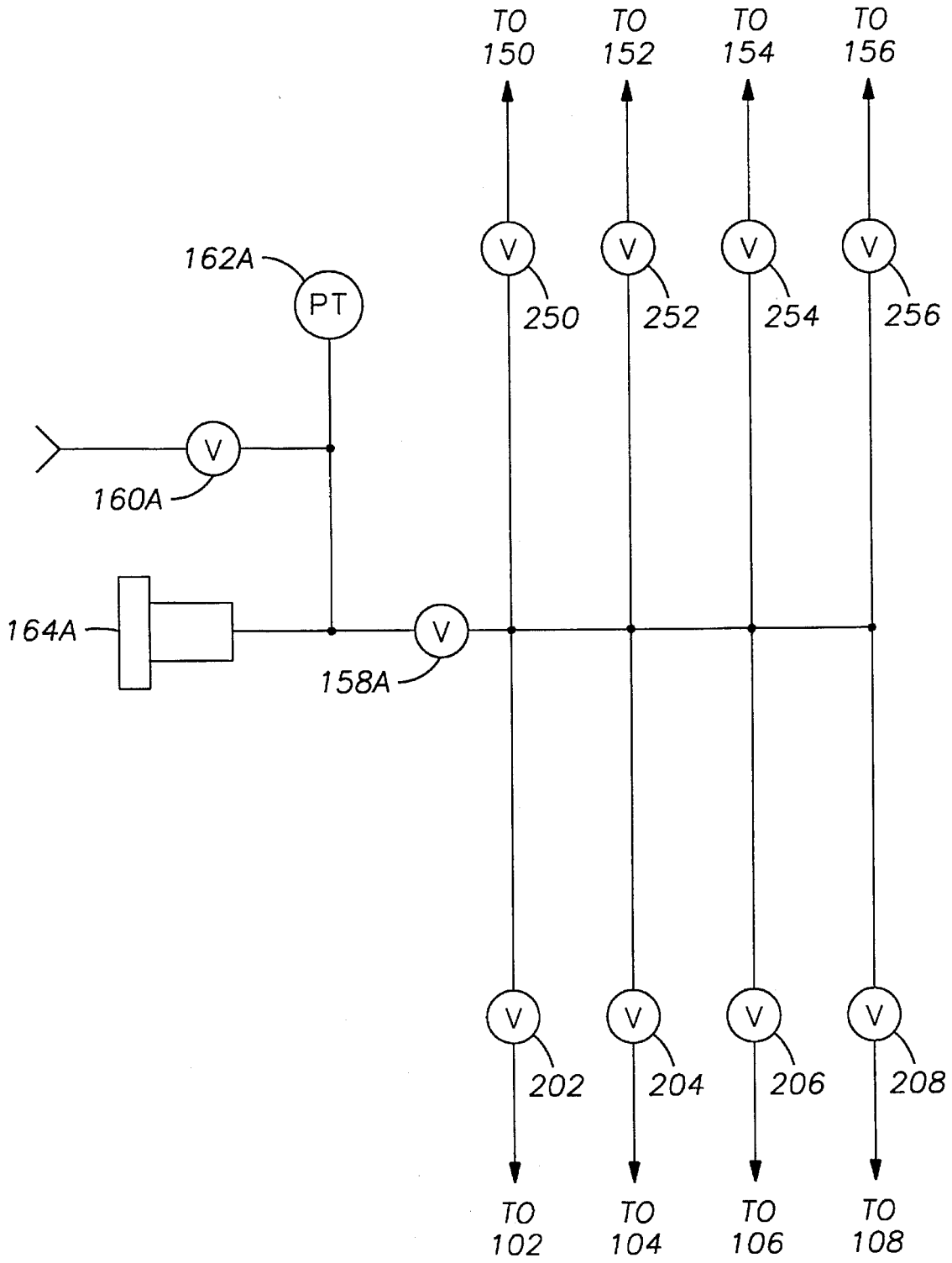
FIG. 4B shows selective connections to the discharge side of the pump.

Referring now to FIG. 4, the hydraulic interconnections of the flow ports (such as 38 in FIG. 2) to various selective valves in the tool will be described. Hydraulic connections to the individual flow ports, made through the previously described hoses (such as one shown at 31 in FIG. 2) are coupled to connectors 102, 104. 106 and 108 in the lower seal section (20 in FIG. 1), and are coupled to connectors 150. 152, 154 and 156 in the upper seal section (18 in FIG. 1). All of the connectors in FIG. 4 can be hose-to-line couplings of a type known in the art.

Through appropriate operation of various valves, each individual flow port can be selectively hydraulically connected to one of several different terminations. The terminations can include connection to the intake of a fluid pump 164, isolation from the other ports, or can include connection to a differential pressure transducer (which will be further explained) for measurement of a pressure difference between that port and another port.

For example, a port in the second seal section (20 in FIG. 1) can be isolated from the all the other ports and from the pump 164 by closing an isolation valve, such as shown at 101, 103, 105 and 107 corresponding to ports connected to connectors 102. 104, 106 and 108, respectively. Similarly, in first seal section (18 in FIG. 1), valves 142, 144, 146 and 148 can be selectively closed to isolate the ports connected, respectively, to connectors 150, 152, 154 and 156. The valves can be electrically operated solenoid valves of a type familiar to those skilled in the art. Operation of each valve can be individually controlled by the system operator entering appropriate commands into the surface electronics (8 in FIG. 1), which then transmits control signals along the cable (4 in FIG. 1. The control signals can be decoded into electrical operating signals for each valve by the electronics section (16 in FIG. 1), as is understood by those skilled in the art.

Each connector can be hydraulically interconnected to an adjacent connector through a differential pressure transducer ("DPT"), such as a first DPT shown at 110 interconnecting connectors 102 and 108, a second DPT at 112 interconnecting connectors 102 and 104, a third DPT at 114 interconnecting connectors 104 and 106, and a fourth DPT interconnecting connectors 106 and 108. Similar interconnections of the connectors for the upper seal section (18 in FIG. 1) through DPT's can be observed at 134, 136, 138 and 140. The DPT's can be of a type known in the art generating an electrical signal corresponding to the difference in pressure between the inputs to the DPT. The electrical signals from each DPT can be provided to the electronics section (16 in FIG. 1) for transmission to the surface electronics (8 in FIG. 1) for decoding and interpretation, as will be readily apparent to those skilled in the art.

Hydraulic connection of each one of the connectors described herein can further be isolated from the pump 164 by additional valves interposed between the DPT connections and the intake to the pump 164. The additional valves are shown at 118. 120, 122, and 124 corresponding to the lower seal section (20 in FIG. 1) and at 126, 128, 130 and 132 corresponding to the upper seal section (18 in FIG. 1). The additional valves can also be electrically operated solenoid valves which are controlled by the system operator entering appropriate commands into the surface electronics (8 in FIG. 1). The additional valves enable measurement of differential pressure between two ports while isolating those two ports from the pump 164 for certain types of formation tests.

On the side of the additional valves nearest the pump 164, the hydraulic connections from each port are joined into a single line (not separately designated). The single line is connected to a pump isolation valve, shown at 158. The opposite side of the pump isolation valve 158 is connected to the intake of the pump 164. The intake of the pump 164 is also connected to a pressure transducer 162 which can be of a type known in the art generating electrical signals corresponding to the pressure applied to the pressure input of the transducer 162. As can be readily understood by those skilled in the art, the electrical signals can be conducted to the electronics section (16 in FIG. 1) for transmission to the surface electronics (8 in FIG. 1) decoding and interpretation. The pump 164 intake is further connected to an equalizer valve 160, which can also be an electrically operated solenoid type known in the art. The equalizer valve 160 is provided to enable pressure balancing between the hydrostatic pressure in the wellbore (2 in FIG. 1) and any of the ports in either the first or second seal section (18 or 10 in FIG. 1) from which fluid may have been withdrawn and the pressure at that port correspondingly reduced. Equalizing the pressure can reduce the possibility that the tool (10 in FIG. 1) might become stuck in the wellbore 2.

The pump isolation valve 158 can be closed to enable operation of the pump 164 for withdrawing fluid, for example, from the wellbore 2 while differential pressure measurements can be made between radially spaced-apart ports as previously described herein as fluid from the wellbore is discharged into the formation through some of the ports, as will be further explained.

The flow ports can also be selectively connected to the discharge of a second pump, shown at 164A. In the preferred embodiment of the invention, the previously described fluid pump 164 can be a two-cylinder, bi-directional, reciprocating pump of a type known in the art comprising intake and discharge check valves (not shown) to provide a common intake line (not shown) and a common discharge line (not shown) from both sides of the pump 164. The bi-directional pump known in the art can perform the functions of both the fluid pump 164 and the second pump 164A. The second pump 164A described in the preferred embodiment of the invention can therefore include the common discharge line (not shown) of the single, bi-directional, reciprocating pump. The discharge of the second pump 164A can also include connection to a second pump isolation valve 158A, a second pressure transducer 162A, and a second equalizer valve 160A. It is to be understood that other arrangements of fluid pumps providing fluid intake at the pump equalizer valve 158 and fluid discharge at the second pump equalizer valve 158A can perform substantially the same pumping functions as the single, bi-directional, reciprocating pump of the preferred embodiment. Including the bi-directional reciprocating pump should not be construed as a limitation of the present invention.

Discharge from the second pump 164A can be selectively connected to any one or combination of ones of the previously described connectors 102, 104, 106, 108, 150, 152, 154, 156 by operation of discharge control valves, shown respectively at 202, 204, 206, 208, 250, 252, 254 and 256. Selective fluid discharge can be used for various types of tests to be preformed on the earth formations (12 and 14 in FIG. 1) as will be further explained. The discharge control valves can also be electrically operated solenoid valves of a type known in the art. Control signals for the discharge control valves can be generated by the surface electronics (8 in FIG. 1) in response to the system operator providing appropriate commands. The control signals can be decoded in and conducted to the valves from the electronics section (16 in FIG. 1) as will be readily understood by those skilled in the art.

By operating the isolation valves, the additional isolation valves, the pump isolation valves and the discharge control valves in the appropriate sequences, the system operator can perform various tests on the earth formations (12, 14 in FIG. 1) which may be indicative of certain hydraulic properties of the earth formations (12, 14 in FIG. 1). For example, the valves can be operated so as to cause the pump 164 to withdraw fluid from the formation through all four of the ports on the first seal section (18 in FIG. 1). All of the valves connected to the flow ports on the second seal section (20 in FIG. 1), as shown at 118, 120, 122 and 124, can be closed to enable differential pressure measurement to be made between any two adjacent ports on the second seal section (20 in FIG. 1). Differential pressure developed between two adjacent ports on the second seal section could be indicative of hydraulic discontinuities in the earth formations (12, 14 in FIG. 1), as is understood by those skilled in the art.

After identification of an hydraulic discontinuity at two adjacent ports as previously described, it is further possible, for example, to operate the valves to selectively direct the discharge of the second pump 164A from one of the ports associated with the discontinuity, and to measure the pressure at selected individual ones of the adjacent ports, until the hydraulic discontinuity is resolved between two ports.

In another type of test of the earth formation, it is possible to operate all of the valves associated with ports of the same seal section (such as 18 or 20 in FIG. 1) to connect those ports to the pump intake 164, thereby causing the tool (10 in FIG. 1) to withdraw fluid from a zone in the earth formation (12 or 14 in FIG. 1) positioned between the seal lips (32, 34 in FIG. 2) on the bladder (26 in FIG. 2). When the valves are operated in this configuration, the DPT's are all in hydraulic communication with their respective interconnected flow ports, therefore differences in pressure between any two adjacent ones of the ports can indicate radial differences in permeability of the earth formation (12, 14 in FIG. 1).

Many other types of tests of the earth formation which can resolve axial or radial differences in fluid flow properties can be readily devised by those skilled in the art using the apparatus of the present invention. It is to be further understood that the valve arrangement disclosed herein is not an exclusive representation of the possible valve arrangements which can perform the functions of the present invention. Accordingly, the invention should be limited in scope only by the claims appended hereto.

What is claimed is:

1. An apparatus for withdrawing fluid from an earth formation penetrated by a wellbore, comprising:

an elongated housing adapted to traverse said wellbore;

a first inflatable elastomeric seal disposed on said housing, said first seal adapted to expansively fill an annular space between said housing and said wellbore, said first seal including axially spaced apart seal lips protruding from an exterior surface of said first seal, said seal lips circumscribing said first seal and defining a flow channel therebetween, said flow channel including radially spaced apart filler blocks dividing said channel into a plurality of segments, said filler blocks substantially preventing flow of fluid between said segments when said seal is inflated to fill said annular space, each of said segments further including a flow port therein;

means for selectively inflating said first elastomeric seal disposed within said housing;

valves hydraulically connected to each one of said flow ports for connecting first selected ones of said flow ports to an intake of a fluid pump disposed within said housing, said valves for connecting second selected ones of said flow ports to a discharge port of said pump, said fluid pump selectively operable in conjunction with said valves to withdraw fluid from said selected ones of said flow ports and to discharge fluid into said other selected ones of said flow ports;

a fluid discharge port connected to said valves and in hydraulic communication with said wellbore so that fluid withdrawn frown third selected ones of said flow ports can be selectively discharged into said wellbore and fluid selectively withdrawn from said wellbore can be selectively discharged through said third selected ones of said flow ports; and a pressure transducer connected to said intake of said pump so that a pressure of said fluid withdrawn by said pump can be determined.

2. The apparatus as defined in claim 1 further comprising a second pressure transducer connected to said discharge of said pump for measuring pressure of fluids discharged from said pump.

3. The apparatus as defined in claim 1 further comprising:

a second inflatable elastomeric seal disposed on said housing at an axially spaced apart location from said elastomeric seal, said second seal adapted to expansively fill said annular space between said housing and said wellbore, said second seal including second axially spaced apart seal lips protruding from an exterior surface of said seal, said seal lips circumscribing said second seal and defining a second flow channel therebetween, said second flow channel including second radially spaced apart filler blocks dividing said second channel into a second plurality of radial segments, said second filler blocks substantially preventing flow of fluid between said second segments when said second seal is inflated to fill said annular space, each of said second segments further including a flow port therein;

second means for selectively inflating said second elastomeric seal disposed within said housing; and additional valves connected to each one of said flow ports in said second elastomeric seal for connecting selected ones of said flow ports thereon to an intake of a fluid pump disposed within said housing, said additional valves for connecting selected other ones of said flow ports on said second seal to a discharge port of said pump, said fluid pump selectively operable in conjunction with said additional valves to withdraw fluid from said selected ones of said flow ports on said second seal and to discharge fluid into said selected other ones of said flow ports on said second seal.

4. The apparatus as defined in claim 3 wherein said second elastomeric seal comprises four of said second filler blocks defining four of said second segments and four of said flow ports, said second filler blocks radially spaced apart from each other at an angle of about ninety degrees, one of said flow ports disposed within each one of said four segments.

5. The apparatus as defined in claim 3 further comprising differential pressure transducers selectively hydraulically connected between adjacent ones of said flow ports on said second elastomeric seal, said differential pressure transducers selectively connected to said flow ports to provide resolution of radial differences in fluid pressure of said earth formation when said fluid is discharged into said formation through said flow ports in said elastomeric seal.

6. The apparatus as defined in claim 3 further comprising differential pressure transducers selectively hydraulically connected between adjacent ones of said flow ports on said second elastomeric seal, said differential pressure transducers selectively connected to said flow ports to provide resolution of radial differences in fluid pressure of said earth formation when said fluid is withdrawn from said formation through said flow ports in said elastomeric seal.

7. The apparatus as defined in claim 1 wherein said first elastomeric seal comprises four of said filler blocks defining four of said segments and four of said flow ports, said filler blocks radially spaced apart from each other each other at an angle of about ninety degrees, one of said flow ports disposed within each one of said four segments.

8. The apparatus as defined in claim 1 further comprising differential pressure transducers selectively hydraulically connected between adjacent ones of said flow ports, said differential pressure transducers selectively connected to said flow ports to provide resolution of radial differences in fluid pressure of said earth formation when said fluid is withdrawn from said formation through said adjacent ones of said flow ports.

9. The apparatus as defined in claim 1 further comprising differential pressure transducers selectively hydraulically connected between adjacent ones of said flow ports, said differential pressure transducers selectively connected to said flow ports to provide resolution of radial differences in fluid pressure of said earth formation when said fluid is discharged into said formation through said adjacent ones of said flow ports.

10. The apparatus as defined in claim 1 further comprising a sample tank connected to said housing, said tank selectively hydraulically connectible to said fluid pump, said tank for storing and transporting samples of said fluid to the earth's surface, said tank for transporting fluid from the earth's surface for selectively discharging into said earth formation.

11. A probe for a formation testing tool adapted to withdraw fluid from an earth formation penetrated by a wellbore, comprising:

an elongated housing;

an inflatable elastomeric seal mounted externally to said housing, said seal slidably mounted to said housing on one end and sealably mounted at said one end, said seal including circumscribing seal lips protruding tram an external surface of said seal, said seal lips axially spaced apart and defining a flow channel therebetween, said flow channel including radially spaced apart filler blocks, said filler blocks dividing said channel into segments, said filler blocks substantially preventing flow of fluid between said segments when said seal is inflated to fill an annular space between said housing and a wall of said wellbore;

a flow port disposed within each one of said segments, so that each one of said segments can be selectively placed in hydraulic communication with a selected part of said formation testing tool, thereby enabling radially segmented testing of a portion of said earth formation disposed between said sealing lips.

12. The probe as defined in claim 11 further comprising four of said filler blocks radially spaced apart from each other at an angle of about ninety degrees.

13. The probe as defined in claim 12 further comprising four of said flow ports each disposed within one of said segments.

14. A method of determining presence of hydraulic discontinuities in an earth formation penetrated by a wellbore comprising the steps of:

positioning a formation testing tool into said wellbore adjacent to said earth formation;

hydraulically isolating a first and a second portion of said earth formation by expanding respectively a first seal and a second seal against a wall of said wellbore, said first seal and said second seal comprising radial flow isolation for hydraulically isolating radial segments of said first and said second portions;

operating valves and a pump disposed in said testing tool to selectively withdraw fluid from said first portion;

measuring fluid pressure at each one of said radial segments of said second portion;

determining presence of said discontinuities from differences in pressure between said radial segments of said second portion.

15. The method as defined in claim 14 further comprising measuring differential pressure between said radial segments in said second portion and determining presence of said discontinuity from said differential pressure measurements.

16. A method of determining hydraulic discontinuities in an earth formation penetrated by a wellbore comprising the steps of:

positioning a formation testing tool into said wellbore adjacent to said earth formation;

hydraulically isolating a first portion and a second portion of said earth formation by expanding a first seal at said first portion against a wall of said wellbore and expanding a second seal at said second portion against said wall of said wellbore, said first seal and said second seal hydraulically isolating radial segments of said first and said second portions;

operating valves and a pump disposed in said testing tool to selectively withdraw fluid from said wellbore and discharge said fluid into said radial segments of said first portion;

measuring fluid pressure at each one of said radially isolated segments of said second portion;

determining presence of said discontinuities by observing differences in pressure between said radial segments of said second portion.

17. The method as defined in claim 16 further comprising measuring differential pressure between said radial segments in said second portion and determining presence of said discontinuities by observing differential pressures between said segments of said second portion.

18. The method as defined in claim 16 further comprising measuring differential pressure between said radial segments in said first portion and determining presence of radial permeability discontinuities in said first portion by observing said differential pressure measurements.

19. A method of determining hydraulic discontinuities in an earth formation penetrated by a wellbore comprising the steps of:

positioning a formation testing tool into said wellbore adjacent to said earth formation;

hydraulically isolating a first and a second portion of said earth formation by expanding respectively a first seal and a second seal against a wall of said wellbore, said first seal and said second seal for hydraulically isolating radial segments of said first portion and said second portions;

operating valves and a pump disposed in said testing tool to selectively withdraw fluid from said first portion and said second portion;

measuring differential pressure between said radially isolated segments of said first portion and between said radially isolated segments in said second portion;

determining presence of said discontinuities from differences in pressure between said segments of said first portion and differences in pressure between segments of said second portion.

20. The method as defined in claim 19 further comprising:

operating said valves and said pump to discharge a fluid transported with said testing tool in a sample tank, said step of discharging directed into said first portion and said second portion;

measuring differential pressure between said radial segments in said first portion and said second portion; and determining presence of said discontinuities by observing said differential pressure measurements.

* * * * *